US005836193A

United States Patent [19]

Hunter et al.

[11] Patent Number: 5,836,193

[45] Date of Patent: Nov. 17, 1998

[54] APPARATUS FOR FORMING ELONGATED METAL ARTICLES AND RELATED METHOD

[75] Inventors: Daniel E. Hunter, Export; Lawrence W. Cisko, Harrison City; Jeffrey M. Shoup, Delmont; Blair T. Allison, Cheswick; Daniel Bergstrom, Sarver; Peter J. Coppola, Cecil, all of Pa.; Walter R. Reichelt, Jr., Bloomfield Hills, Mich.; William A. Graham, McDonald, Pa.

[73] Assignee: Aluminum Company of America, Pittsburgh, Pa.

[21] Appl. No.: 753,614

[22] Filed: Nov. 27, 1996

[51] Int. Cl.[6] ..... B21D 11/02

[52] U.S. Cl. ..... 72/298; 72/311; 72/306

[58] Field of Search ..... 72/306, 298, 311, 72/295, 383, 399, 387

[56] References Cited

U.S. PATENT DOCUMENTS

| | | | |
|---|---|---|---|
| 2,944,582 | 7/1960 | Ahonen | 72/298 |
| 3,832,879 | 9/1974 | Holden | 72/306 |
| 5,327,764 | 7/1994 | Weykamp et al. | 72/296 |
| 5,588,322 | 12/1996 | Passone | 72/298 |

FOREIGN PATENT DOCUMENTS

| | | | |
|---|---|---|---|
| 245599 | 5/1987 | Germany | 72/306 |
| 118230 | 7/1984 | Japan | 72/383 |

*Primary Examiner*—Daniel C. Crane

*Attorney, Agent, or Firm*—Arnold B. Silverman; Thomas R. Trempus

[57] ABSTRACT

Apparatus and a method for forming an elongated workpiece are provided. In a first embodiment, a press has a ram and movable upper platen to which is secured a first die. Upper guide members are provided on the upper platen for movement of slide members on each responsive to movement of the platen. Lower guide elements, which cooperate in a telescoping manner with upper guide members, are secured to a lower platen. The first die cooperates with a pair of rotatable second die members which are provided with each being rotatable responsive to movement of a slide member. In a preferred embodiment, the upper guide members secured to the platens are in relative sliding contact and links connect the slide members with the rotatable second dies. In a preferred embodiment, the elongated metal workpiece may be formed by bending under the influence of the forces applied to the first die and second die members through the upper platen by the press ram. In a second embodiment, the press first die and associated guide members are not employed and forming is effected by the second die members. Associated methods are provided.

25 Claims, 12 Drawing Sheets

APPARATUS FOR FORMING ELONGATED METAL ARTICLES AND RELATED METHOD

BACKGROUND OF THE INVENTION

1. Field of the Invention

The present invention is directed toward apparatus and an associated method for effecting forming of an elongated metal article in a precise, rapid automated manner.

2. Description of the Prior Art

It has been known for numerous purposes to form elongated metal articles in single or multistage processes in order to convert semi-fabricated products into finished products. It has been known to form tubular aluminum extrusions by gripping the ends thereof, applying tensile force to stretch the extrusion beyond the yield point, and subsequently effecting the desired bending so as to effect permanent deformation of the extrusion into the desired shape.

It has been known to effect bending of such elongated metal articles by gripping the ends, applying tension, and employing cooperating dies in reforming the workpiece to effect permanent deformation thereof.

Despite known prior systems, there is lacking an effective means for rapidly and reliably forming elongated metal articles in a precise and economically effective manner.

SUMMARY OF THE INVENTION

The present invention has met the above-described need by providing apparatus which in one embodiment effects coordinated closing movement of a first die member secured to a first platen movable under the influence of a ram of a suitable press and a second platen which has a pair of die members which are rotatable responsive to relative closing movement between the first die and second die members. Such closing movement is preferably effected by moving the first platen toward the second platen.

In this embodiment of the invention, the first platen has a plurality of guide members disposed on each side of the first die member and the second platen has a cooperating contacting slidably engageable set of guide elements such that when relative closing movement is effected between the first platen and the second platen during the forming operation, the guide members and guide elements telescope with respect to each other.

A first slide member and a second slide member are mounted for linear sliding movement on the guide members and are each mechanically rotatably secured to one of the second die members such that downward movement of the platen will effect rotational movement of the second die members. After the desired forming has occurred, the first platen is moved in a direction which separates first die member from second die members and rotation of the second die members in the opposite rotational direction is effected.

The method of this embodiment of the invention involves providing a first die member mounted on an upper platen cooperating with second die members mounted on a lower platen, positioning the elongated workpiece between the first die member and the second die members and effecting relative closing movement between the first die member and the second die members by relative closing movement of the first platen. Relative closing movement of the platen also serves to effect rotational movement of the second die members in order to effect the desired forming of the workpiece between the first die member and second die members.

In another embodiment, the movable platen and first die are eliminated and mechanical means provide the desired forming of the workpiece by the second die members. In one approach to this embodiment, a pair of hydraulic cylinders effect rotation of the second dies. This embodiment, therefore, has reciprocating movement of the hydraulic cylinder rod converted into responsive rotational movement of the second dies with the workpiece having its ends restrained in suitable gripping means.

The invention also provides such systems wherein expandable tapered gripping means are inserted into the tubular workpiece.

In one preferred embodiment of the invention, forming involves bending of an aluminum extrusion into a predetermined shape.

It is an object of the present invention to provide apparatus and a method for effecting forming of an elongated metal workpiece in a rapid, automated and efficient manner.

It is a further object of the present invention to provide for such forming wherein in one embodiment press ram initiated movement of a first platen to establish relative closing movement of the die members against the workpiece causes translational movement of a first die member and rotational movement of the second die members.

It is a further object of the present invention to provide another embodiment wherein rotation of the second die members effect the desired forming without requiring the use of the movable platen or first die member of the other embodiment.

It is another object of the present invention to provide apparatus and an associated method wherein slide members which are movable along guide members serve to effect rotational movement of the second die members as a result of sliding movement of the slide members causing through appropriate linkage rotation of the second members.

It is a further object of the present invention to provide such a system which is useful in forming structural vehicular parts, such as bumpers or roof members, for example.

It is a further object of the present invention to provide such systems wherein expandable tapered grippers are inserted into the hollow or hollows of the workpiece.

These and other objects of the invention will be more fully understood from the following description on reference to the illustrations appended hereto.

DESCRIPTION OF THE PREFERRED EMBODIMENTS

As employed herein, the term "single plane" will refer to a forming operation wherein all of the deformation effected during forming could be illustrated in employing two coordinate axes as distinguished from three coordinate axes ignoring the thickness of the article being formed.

Figure 1:
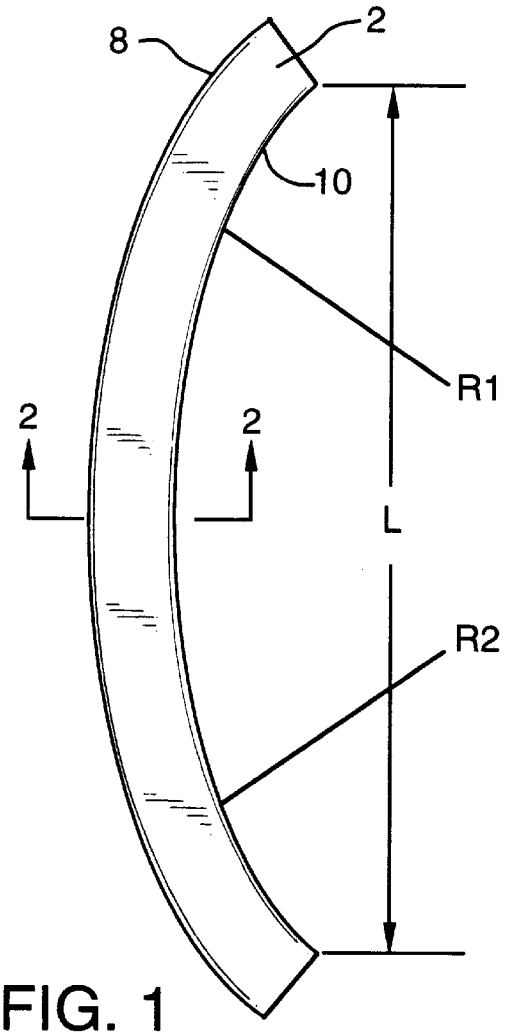
FIG. 1 is a top plan view of a formed metal workpiece created by the apparatus and method of the present invention.
Figure 2:
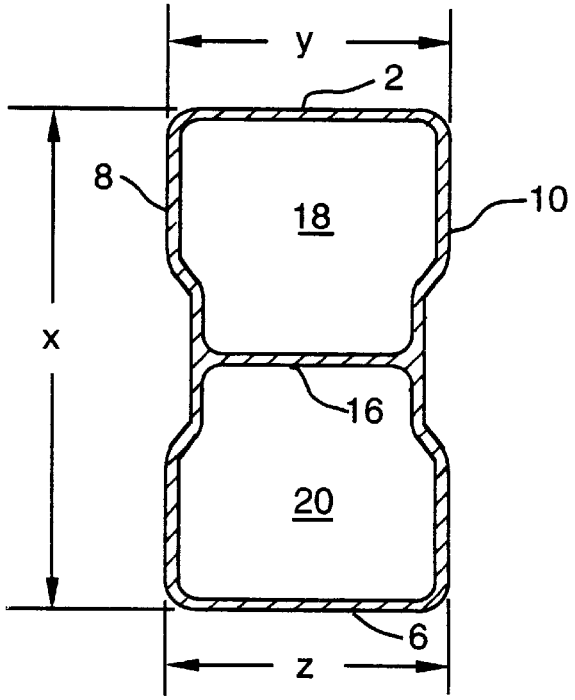
FIG. 2 is a cross-sectional illustration of the formed workpiece of FIG. 1 taken through 2—2.

Referring to FIGS. 1 and 2, an example of a formed article made by the apparatus and method of the present invention will be considered. In this instance, the metal article is an elongated straight aluminum extrusion having multiple hollows. After the process is completed, the article which might become a structural article on a vehicle, such as a bumper, for example, has a curvature of radii $R_1$, $R_2$, which in the form shown are equal so as to present a simple curve. It will be appreciated that any number of radii of any desired size and sequence may be employed. The formed article measured along a straight line connecting the innermost points has a length L. The extrusion has an upper surface 2, a lower surface 6, an outer surface 8, and an inner surface 10. A divider wall 16 cooperates with the other walls 2, 6, 8, 10 to define a first hollow 18 and a second hollow 20. In the form shown, the extrusion has a generally rectangular configuration with center portions being of reduced width. The extrusion has a height x. The upper wall 2 has a width y, the lower wall has a width z, which in the form illustrated, is equal to y. The width y equals z, and in the form shown, may be about 3 inches, and the height x may be about 6 inches.

The apparatus and method of the present invention are adapted to form elongated metal tubular articles having single or multiple hollows of substantial length which may, for example, be on the order of 1 to 2 meters long prior to forming.

Figure 3:
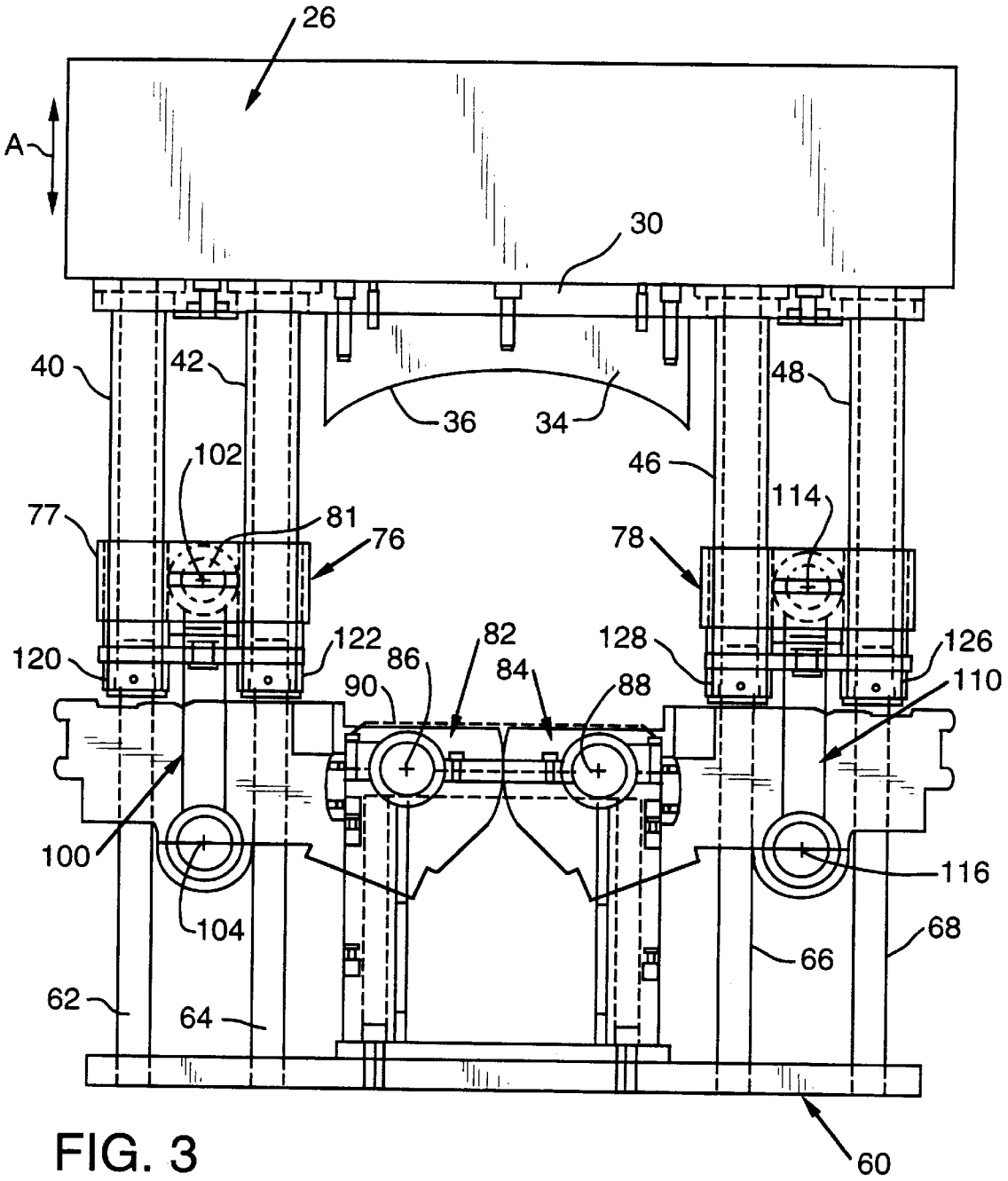
FIG. 3 is a front elevational view of a form of apparatus of the present invention employed to form elongated metal articles.
Figure 4:
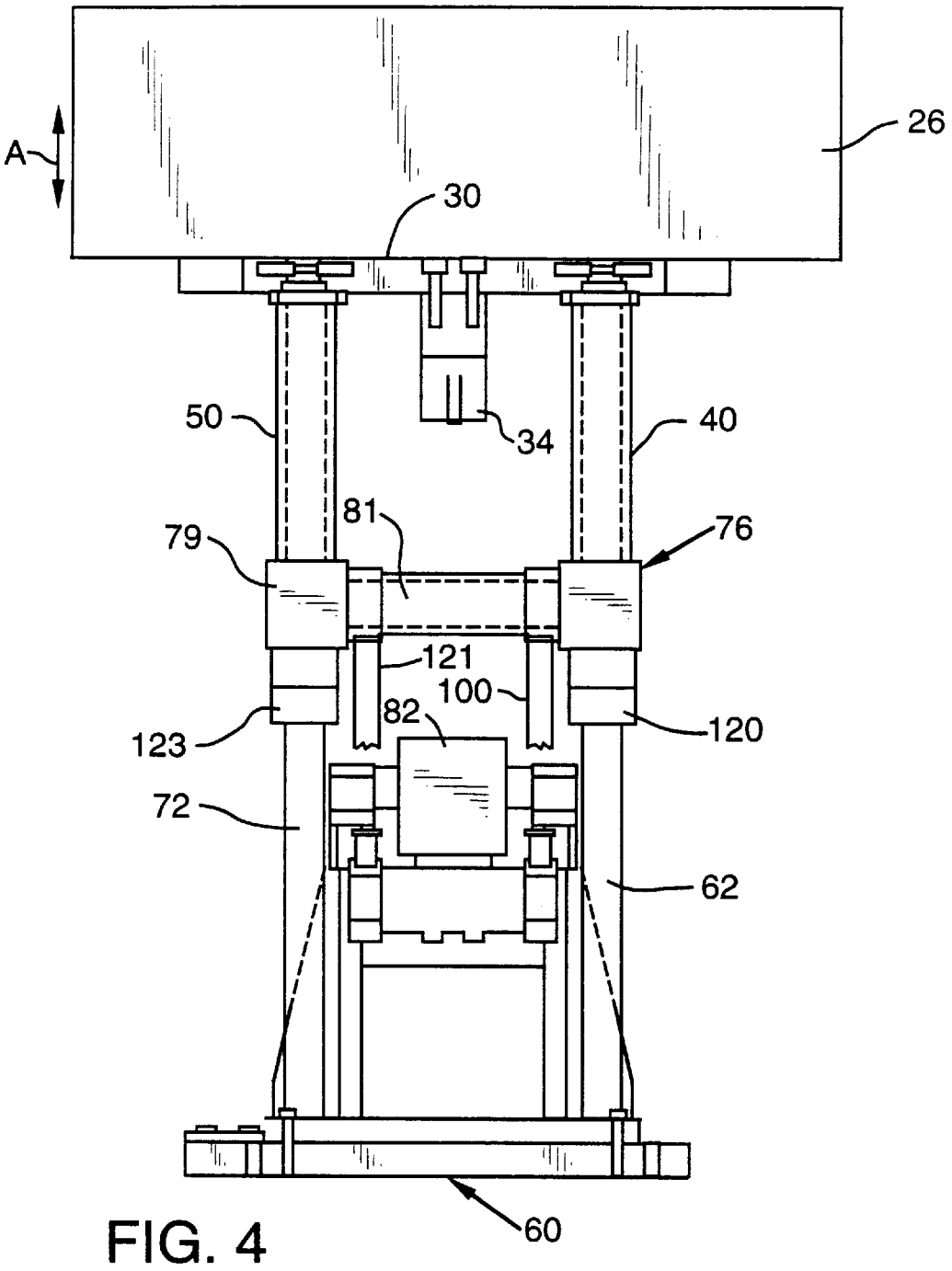
FIG. 4 is a left-side elevational view of the apparatus of FIG. 3.

Referring to FIGS. 3 and 4, a general description of one embodiment of the apparatus of the present invention will be considered. A press, which may be a conventional press of suitable capacity, has a ram 26, which is adapted in use to reciprocate in the direction indicated by two-headed arrow A. Secured to the undersurface of ram 26 by appropriate mechanical fasteners is a first platen 30 which has a first forming die 34 mechanically secured to the undersurface thereof. In the form shown, the first die member 34 has a curved undersurface 36 which will function to contact and form surface 8 of the formed product, as shown in FIGS. 1 and 2. The surface 36 will be as long as the surface 8 (measured along the surface), reduced by the length of the grippers which will be disclosed hereinafter, and will have the same radius of curvature subject to adjustment for possible spring-back after forming. As known to those skilled in the art, die contour will be designed to compensate for spring-back. Such spring-back will be at a minimum as, in general, forming will be done so as to reform the workpiece beyond the yield point in tension. The platen 30 has secured to it four downwardly depending upper guide members 40,42 on each side of die member 34 (two shown) and four upper guide members 46,48 on the other side of the die member (two shown). With reference to FIG. 4, a similar pair of guide members, such as 50, which is disposed in spaced relationship behind guide member 40 and similar guide members disposed behind guide members 42, 46, 48 (not shown) are provided. In the form shown, all of these guide members are tubular.

A lower platen 60 has four upwardly projecting lower guide elements 62, 64 (two shown) on one side of die elements 82,84, which may be solid or tubular and/are slidingly received respectively in upper guide members 40,42 in relative intimate relationship while facilitating sliding movement. Similarly, four lower guide elements 66,68 on the other side of die elements 82,84 (two shown) are received within upper tubular guide members 46,48. Also, as shown in FIG. 4, four rearwardly disposed upwardly projecting guide elements, such as 72, are received within the four rearwardly positioned overlying guide members, such as 50.

Referring to FIGS. 3 and 4, first slide member 76 is slidably received on the exterior of upper guide members 40, 42, 50 and the fourth member (not shown) so as to slide freely thereon. Similarly, a second slide member 78 is slidingly received on the guide members 46, 48 and the two corresponding guide members disposed therebehind (not shown) to permit free sliding movement thereon. The slide members, such as 76, for example, will have passageways which slidingly receive the upper guide members 40,42,50 (fourth guide member not shown) and will provide a rigid, I-shaped frame. With reference to FIGS. 3 and 4, guide member 76 has a front element 77 which is unitary and provides passageways which receive upper guide members 40,42 and a similar rear element 79 which receives guide member 50 (one not shown). Connecting rod 81 connects opposed central portions of front element 77 and rear element 79. The links 100,121 have openings to rotatably receive rod 81.

As shown in FIG. 3, the apparatus has two rotatably second die members 82, 84. The workpiece will generally be positioned with its longitudinal extent oriented from left to right or generally horizontally, as shown in FIG. 3, in recess 90. Die element 82 is mounted for rotation about axis 86 in a counterclockwise direction. Die element 84 is mounted for rotational movement about axis 88 in a clockwise direction. Axes 86, 88, in the form shown, underlie first die member 34. Link member 100 is pivotally secured to slide member 76 at 102 by suitable fastening means and to second die member 82 at 104 by suitable means. Similarly, link member 110 is rotatably secured to slide member 78 at 114 and to second die member 84 at 116. Similarly, a pair of rearwardly positioned links, such as 121, as shown in FIG. 4, will be positioned behind links 100, 110, respectively.

The location of rotational axes 86,88 is selected so as to influence the amount of tension applied to the workpiece and resist undesired buckling of the workpiece due to excessive compressive forces during forming.

As shown in FIGS. 3 and 4, enlarged portions of the lower extremities of upper guide members, such as 120, 122, 126, 128 serve as stop means to limit the downward sliding travel respectively of slide members 76, 78. Corresponding rear stop members, such as 123, are provided on the four rear guide members, such as 50.

It will be appreciated that as the platen moves downwardly under the influence of force applied by ram 26, not only will there be relative closing movement between the first die 34 and the second dies 82, 84, over which the workpiece to be formed (not shown in this view) is positioned, but also as the slide members 76, 78 are urged downwardly by platen 30 in a manner to be disclosed hereinafter, counterclockwise rotation of second die member 82 about axis 86 is effected and clockwise rotation of second die member 84 is also effected, respectively, as a result of the linkage means 100, 110, connecting the slide members 76, 78, respectively, with the second die members 82, 84.

Figure 5:
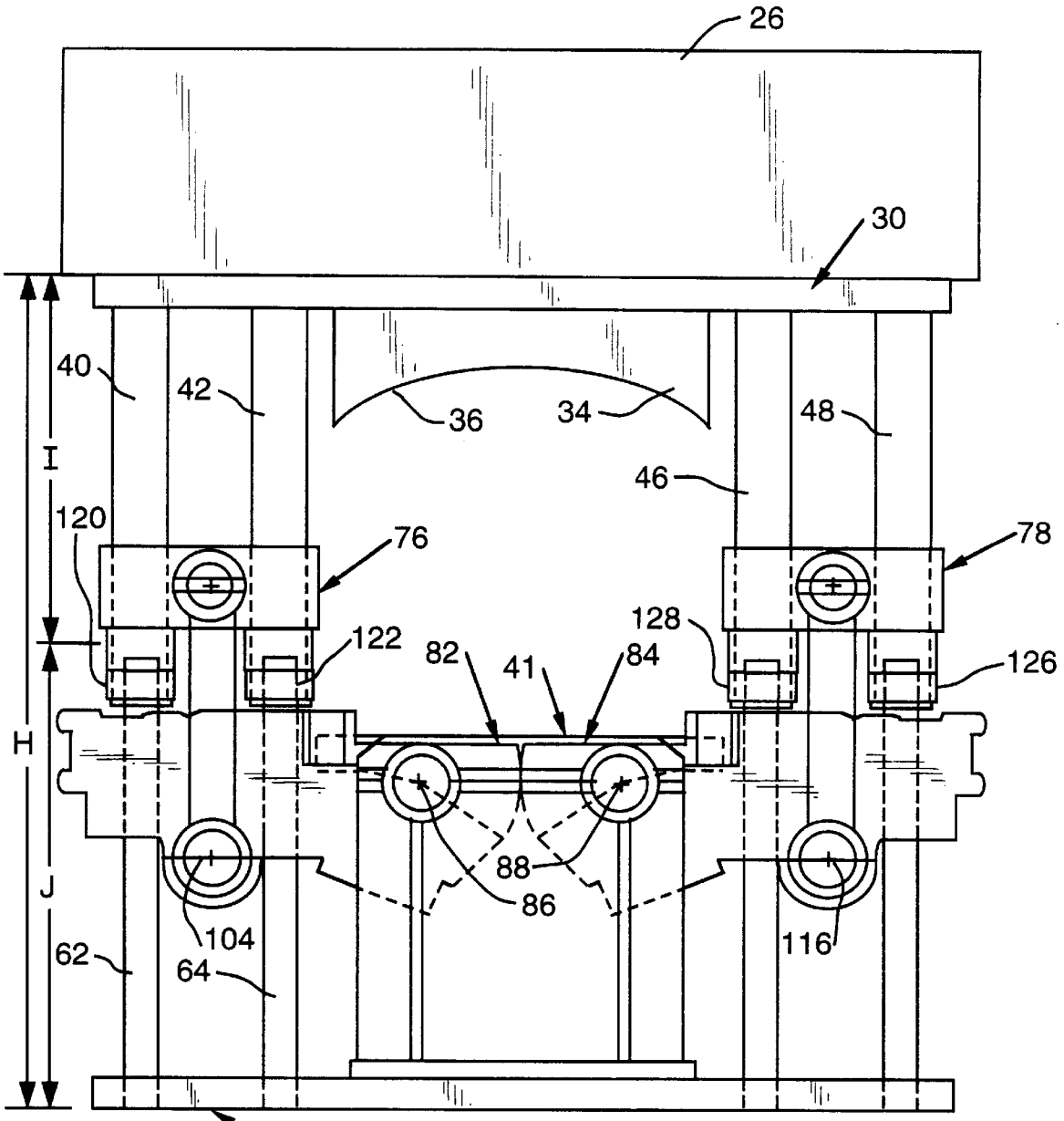
FIG. 5 through 7 are front elevational views illustrating successive stages of forming of an elongated workpiece.
Figure 6:
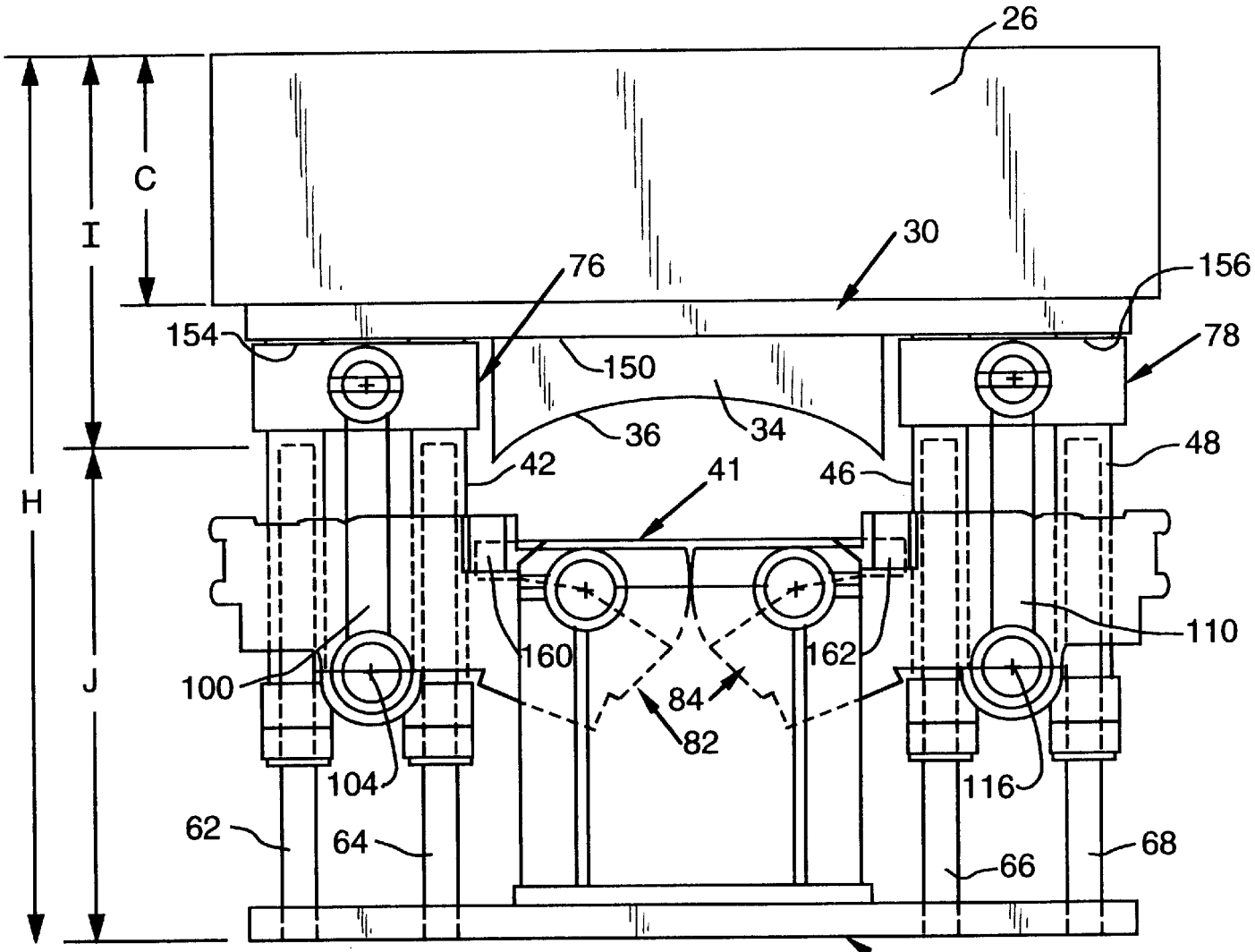
Figure 7:
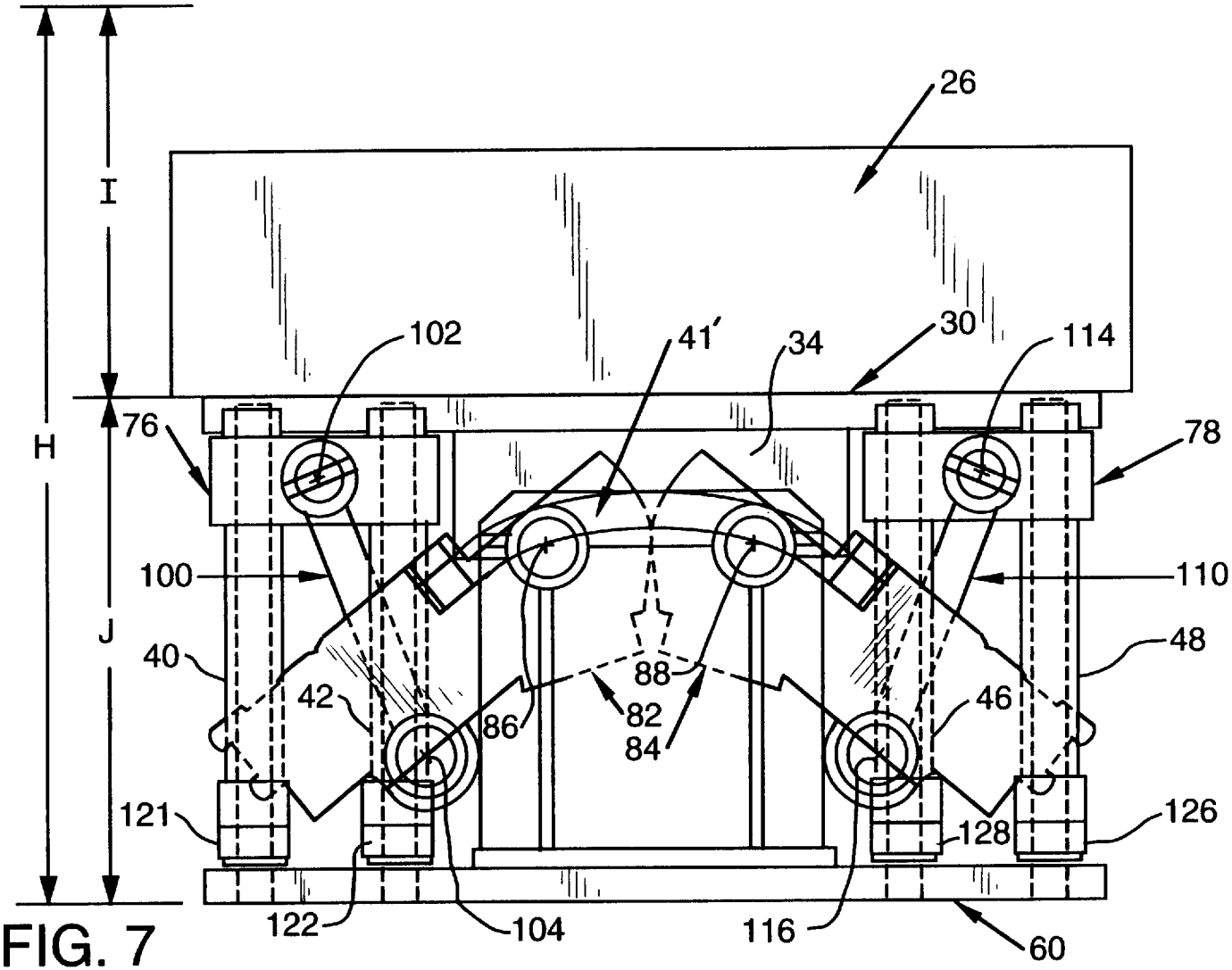

Referring to FIGS. 5 through 7, a typical sequence of operation of the first embodiment of the invention in forming an elongated metal workpiece 41 into a formed product which, in the present example, will be accomplished through bending into a curved shape.

As shown in FIG. 5, the overall distance between the top of the upper platen 30 and the bottom of the lower platen 60 of distance H, when the ram 26 is in its uppermost position, is shown. The closed height of the system, which will be considered hereinafter, when the upper platen 30 is in its lowermost position, is J and the difference is the length of ram stroke I. For example, in one situation, H may equal about 82 inches, with J equalling about 46 inches, and I equalling about 36 inches.

Referring to FIG. 6, which shows an intermediate stage of forming, the platen 30 has moved downwardly to the point where its undersurface 150 is in engagement with the upper portions 154, 156 of slide members 76, 78, respectively. Also, the lower guide members 62, 64, 66, 68 and their counterparts spaced therebehind, such as 72 (FIG. 4), have been telescopingly received within the interior of their corresponding overlying guide members 40, 42, 46, 48 and the four corresponding members appearing therebehind. It will be appreciated that the lower guide members 62, 64, 66, 68, 72 and the additional three members may be of solid or tubular construction in this embodiment. At this point, the forming surface 36 of the upper die 34 has not engaged the workpiece 41. The workpiece 41 has its ends 160, 162 firmly secured within external gripping means. At this point, in the travel of upper platen 30 in the first direction, i.e., downward, it has moved a distance C which, in the context of the example provided hereinbefore, may be about 23.6 inches. This portion of the travel has been free travel in the sense that the upper platen 30 has not applied a downward force to the slide members 76, 78. At this point, in travel of platen 30, the linkage means, such as 100, 110, remain generally vertically oriented.

In the position shown in FIG. 7, the upper platen 30 has moved to its lowermost position and the workpiece 41' which may be an aluminum extrusion, for example, has been bent along a predetermined curved path to achieve the configuration shown in FIG. 1. This has been accomplished due to the interaction of the upper die 34 with the lower die members 82, 84. In this position, the upper guide members 40, 42, 46, 48, 50, and the three additional members not shown, have been fully telescoped and have received therewithin the lower guide elements 62, 64, 66, 68, 72 and the three additional support elements not shown, such that the platen 30 is in its lowermost position. In this position, link 100 has pivoted in a counterclockwise direction about axis 102 and through the influence of its pivotal connection at 104 to lower die element 82 has effected counterclockwise rotation of lower die element 82 about axis 86. Similarly, link 110 has pivoted in a clockwise direction about axis 114 and through rotatable contact 116, has caused second die member 84 to rotate about axis 88 in a clockwise direction. In this manner, bending of the elongated metal workpiece is effected.

Raising of ram 26 will cause responsive raising of upper platen 30 and lifting of upper guide members 40, 42, 46, 48, 50 and the additional three guide members not shown, with the stop members 120, 122, 126, 128 serving to engage the undersurface respectively of slide members 76 and 78 to cause them to move upwardly. With this separation, the formed workpiece 40' may be removed from the apparatus and another substantially straight elongated workpiece may be inserted.

The preferred cycle of operation includes the tubular workpiece 41 being placed in the position shown in FIG. 5. The gripping means which will be described in detail herein clamp the ends of the workpiece. Forming of the workpiece is then effected as shown in FIGS. 6 and 7. The gripping means are then opened to permit ready removal of the formed workpiece. A suitable form of gripping means is that disclosed in U.S. patent application Ser. No. 08/757,403, filed Nov. 27, 1996, entitled "Method of Gripping Tubular Members During Forming Operations and Associated Apparatus".

The method of this embodiment involves providing an upper platen 30 to which a first die 34 has been secured and a lower platen to which two lower die members 82, 84 have been rotatably secured. Guide means are provided which, through telescoping action, permits relative closing movement between upper platen 30 and lower platen 60 so as to cause the upper die 34 and lower dies 82,84 to engage the interposed workpiece 41 and reform it in the desired manner. After a predetermined distance of movement of the upper platen 30 engagement between the platen 30 and the slide members 76,78 will be achieved with further downward motion of the platen causing the linkage 100,110, respectively, between the slide members 76, 78 and the lower die members 82, 84 to effect responsive rotation of the die members 82, 84. After forming has been completed, the process is reversed through the upper platen being raised under the influence of the ram 26.

As presses of the type employable in connection with the present apparatus and method are well known to those skilled in the art, details of the same are not provided herein.

Figure 8:
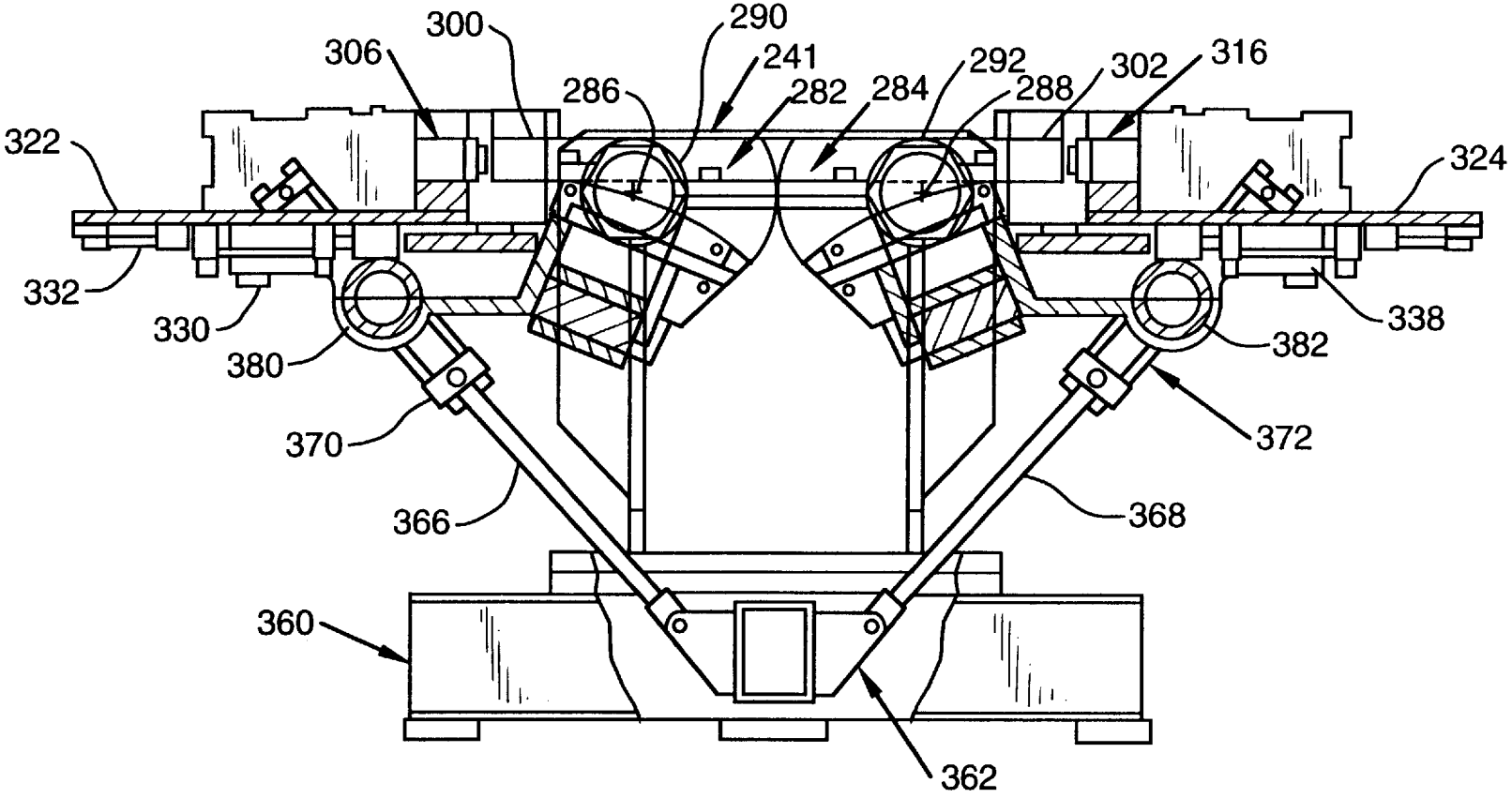
FIG. 8 is an elevational view of a second embodiment of the invention wherein the movable platen and first die member are eliminated with the workpiece shown in its initial configuration.
Figure 9:
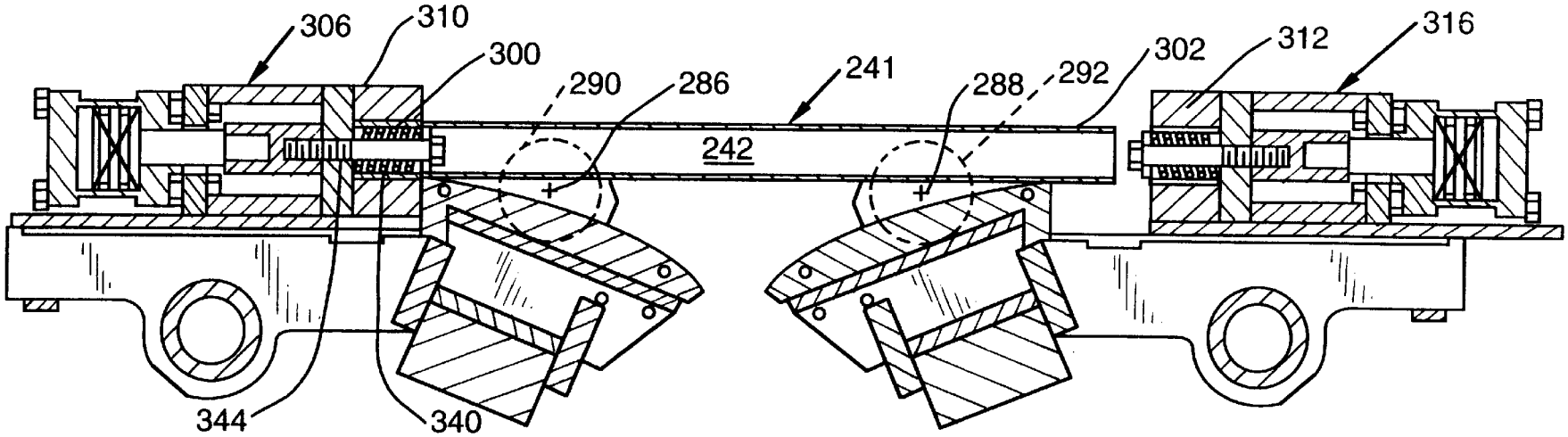
FIG. 9 is an elevational view similar to FIG. 8, but is partially broken away to show details of the workpiece gripping means.

Referring to FIGS. 8 and 9, another embodiment of the invention will be considered. In this embodiment, the press, upper plate, and overlying first die member are eliminated.

In this embodiment, two rotatable lower die members 282, 284 may be identical to dies 82,84. Lower die members 282,284 are rotatable about axes 286,288, respectively. The axes 286,288 of shafts 290,292, respectively, are preferably oriented generally perpendicularly to the longitudinal extent of the workpiece and between the ends thereof. Initial workpiece 241, which may be a straight metal extrusion, is positioned on lower die members 282,284.

Referring to FIGS. 8 and 9, suitable gripping means for securing the workpiece ends will be disclosed. These gripping means may be employed in the first embodiment of the invention as well as other embodiments.

Workpiece 241 is tubular and has hollow 242. The original workpiece may be retained in position by gravity prior to gripping. As shown by way of example in FIG. 9, the left end 300 of workpiece 241 is secured by gripping member 306 and workpiece end 302 is shown as not being gripped.

The gripper means may be of the type disclosed in U.S. patent application Ser. No. 08/757,403, filed Nov. 27, 1996. An annular outer sleeve 310 of gripper means 306 and sleeve 312 of gripper means 316 has an opening which is structured to receive workpiece ends 300,302, respectively. As shown in FIG. 8, gripper means 306 is mounted on pedestal 322 and gripper means 316 is mounted on pedestal 324. Hydraulic cylinder 330 has a piston rod 332 which is secured to pedestal 322 in order to reciprocate the pedestal toward and away from the tube end 300. In FIG. 8, the pedestal 322 is shown at a position wherein the gripper means 306 is positioned outside of the tube end 300 and in FIG. 9 it is shown inside the workpiece end 302.

Once workpiece 241 is in position, the pedestals 322,324 are moved under the influence of hydraulic cylinders 330, 338, respectively, to introduce the gripping means 306,316 into the workpiece ends 300,302, respectively. As shown in FIG. 9, once the gripping means is within the tube end, the gripping means are expanded radially by applying a compressive axial force to the resilient interior material 340 to effect radial expansion thereof and clamp the workpiece end 300 between the resilient interior material 340 and the inner surface of sleeve 310. The axial force may be provided by applying axial rotation of threaded bolt 344 by suitable means (not shown) such as a motor. Once the two ends 300,302 are gripped, forming as by bending may be effected, after which the gripping means are released and withdrawn by reducing the axial compression on the resilient interior material after which the pedestal moves to withdraw the gripping means from the tube end.

The apparatus of FIG. 8 has a fixed base 360 with an anchor plate 362 to which are secured piston rods 366,368, respectively, which are operatively associated, respectively, with hydraulic cylinders 370,372. The hydraulic cylinders 370,372 are rotatably secured to rotatable dies 282,284, respectively, at 380,382, respectively.

As shown in FIG. 8, the workpiece is undeformed and piston rods 366,368 are extended.

Figure 10:
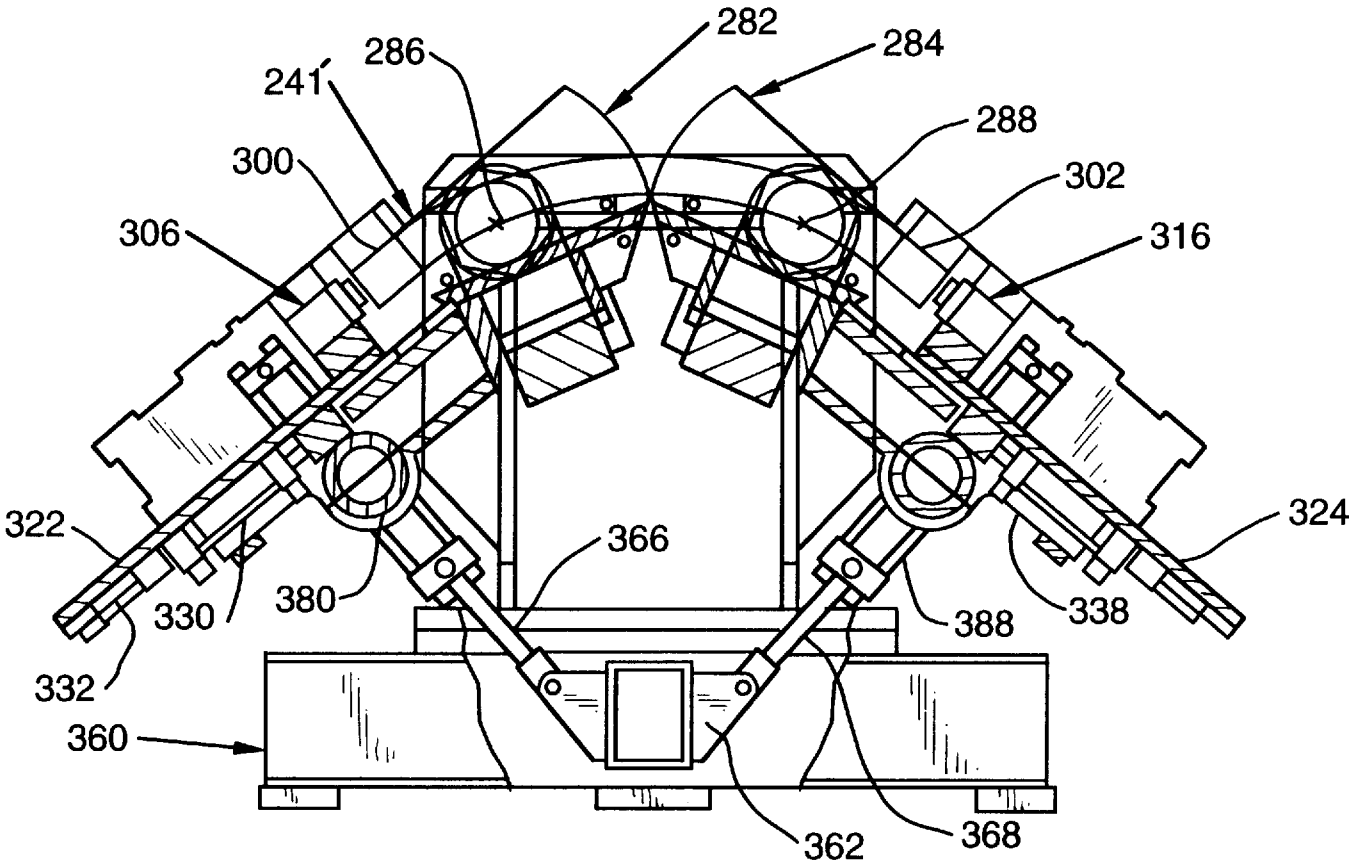
FIGS. 10 and 11 correspond to FIGS. 8 and 9, respectively, but show the workpiece after forming.
Figure 11:
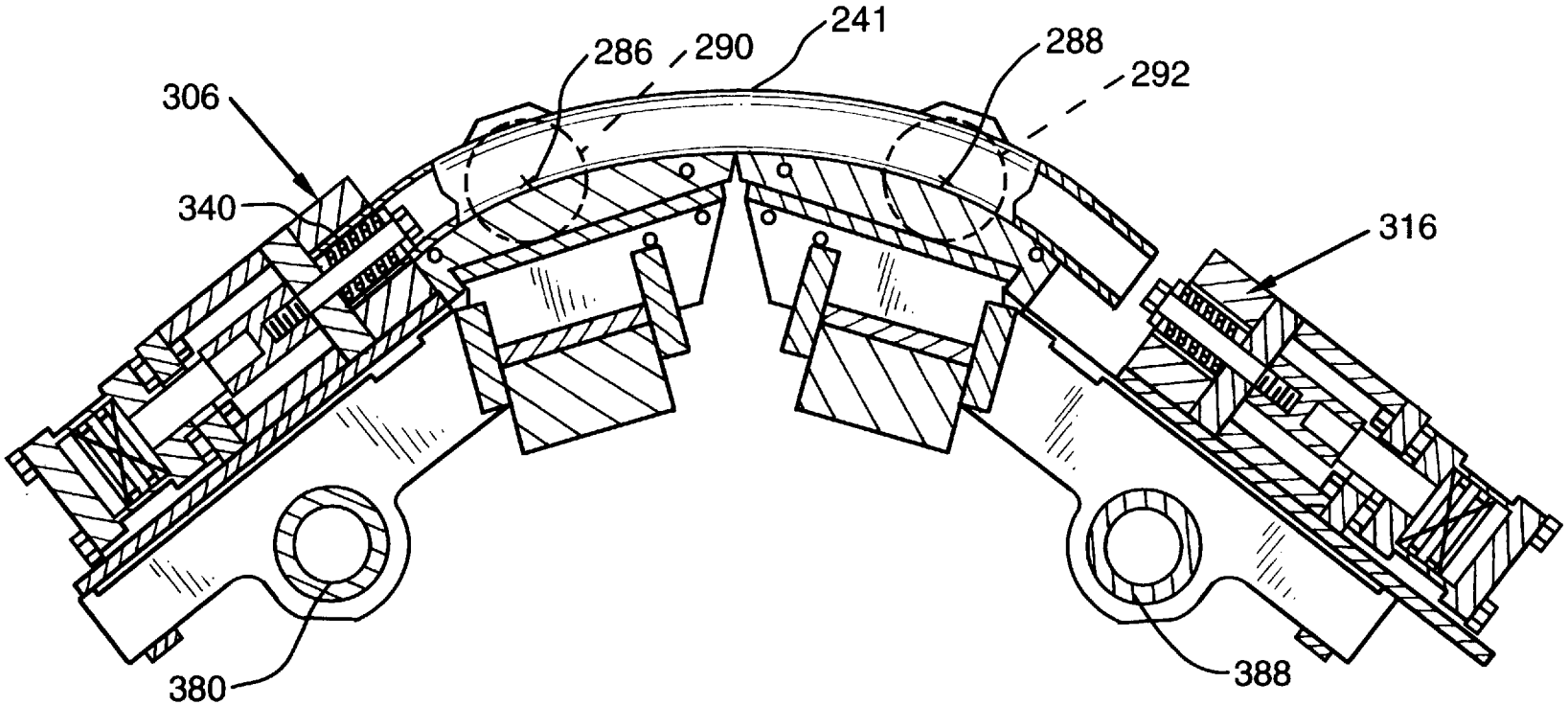

By the action of the hydraulic cylinders 370,372, in retracting the respective rods 366,368, die 282 is caused to rotate in a counterclockwise direction about axis 286 and die 284 is caused to rotate in a clockwise direction about axis 288. This effects application of an initial tensile force on the workpiece 241, to cause it to go beyond the yield point after which bending to the shape of workpiece 140, shown in FIGS. 10 and 11, will be effected. FIG. 10 shows the gripping means 306, 316 released and withdrawn to permit removal of the final product.

Figure 12:
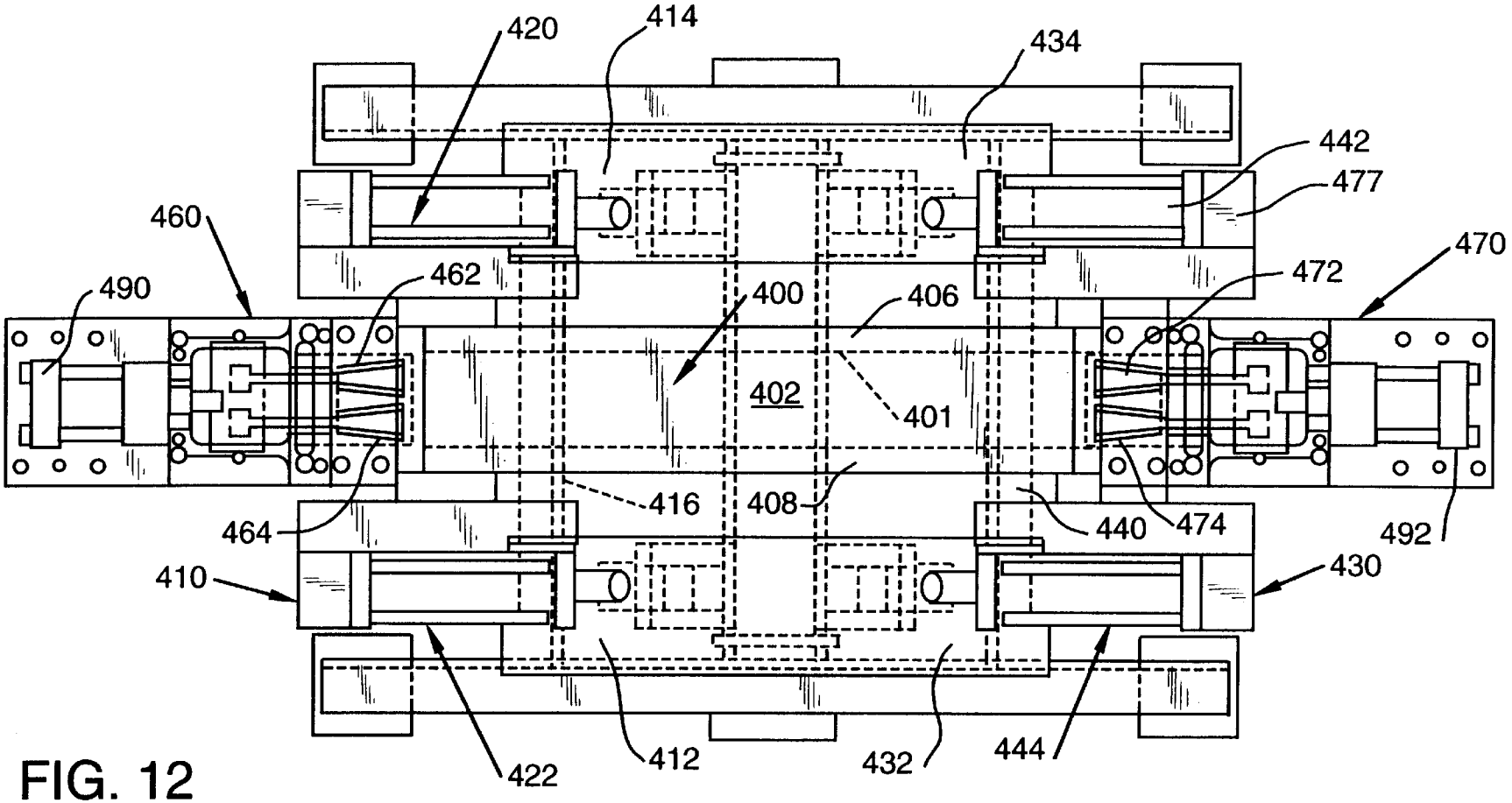
FIG. 12 is a top plan view of the second die members and associated clamping means which shows another embodiment of the clamping means.

FIG. 12 shows a plan view partly in section of the second die members which may be essentially as shown in FIGS. 3 through 5 or FIG. 7. In FIG. 12, a different embodiment of the gripper means, which will be described herein, is shown. A workpiece support 400 is adapted to receive a tubular workpiece 401 on the support base 402 and between lateral walls 406,408. Die member 410 has two components 412, 414, which are rotatable about connecting shaft 416 in a counterclockwise direction responsive to movement respectively of hydraulic cylinders 420,422. Similarly, die member 430 has two components 432,434 which are adapted to be rotated clockwise about connecting shaft 440 responsive, respectively, to movement of hydraulic cylinders 442,444.

Figure 13:
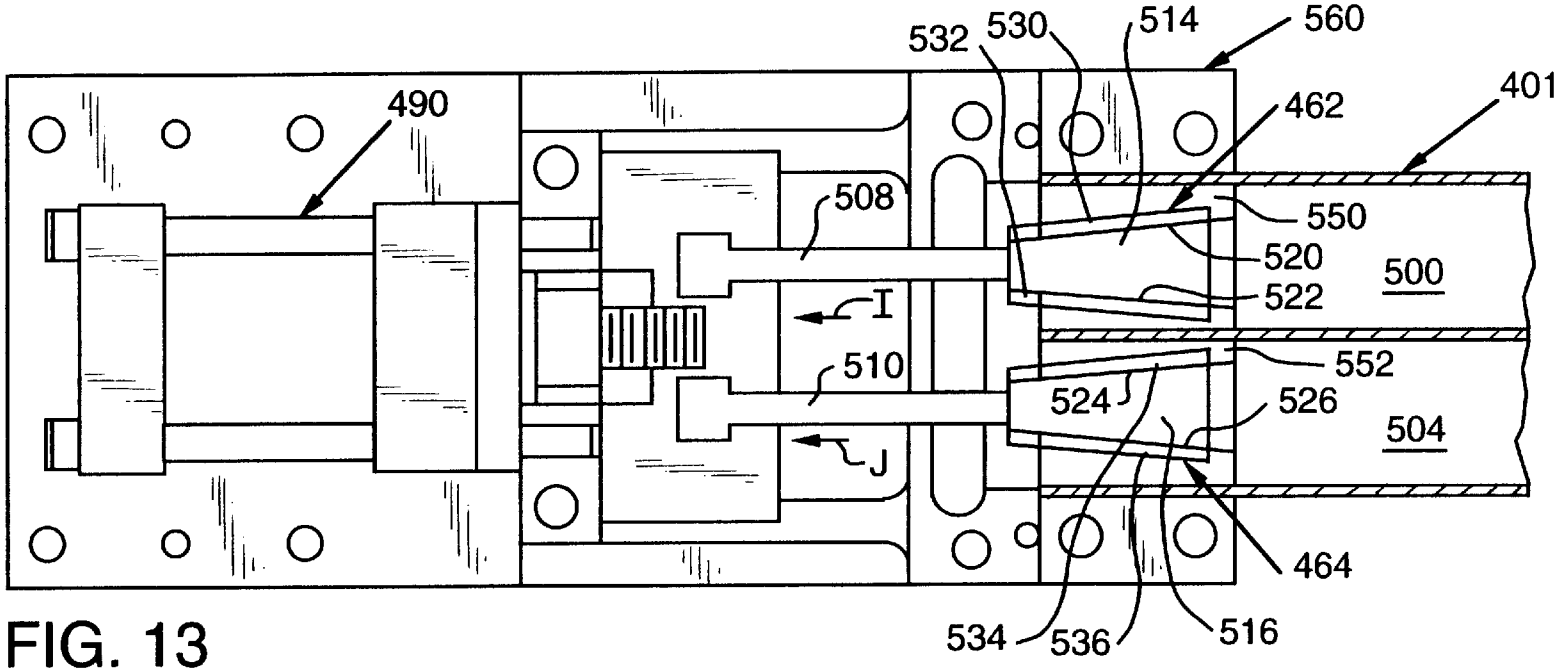
FIG. 13 is an enlarged top plan view of the clamping member of FIG. 12
Figure 14:
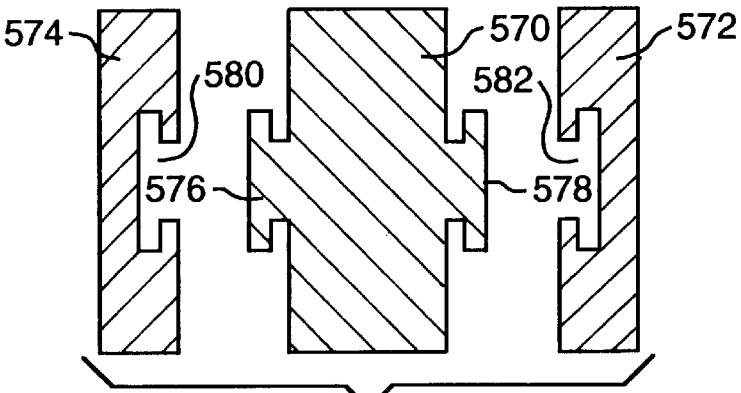
FIG. 14 is a cross-sectional view of a tapered clamping member of this embodiment of the invention.

Referring to FIGS. 12 and 13, the apparatus shown is adapted to grip and form a tubular workpiece which has two hollow portions. In this embodiment of the grippers, tapered metal wedges are employed to effect gripping. The gripper 460 shown at the left is in retracted position and has a first gripper 462 which is to enter one hollow 500 of the workpiece 401 and a second gripper 464 which is to enter the other hollow 504 of the workpiece 401. Gripper 470 is shown in the extended position and has a pair of grippers 472,474. The grippers 460, 470 will each be in the position of gripper 460 before insertion of the workpiece and after forming and will be in the position of gripper 470 during forming. The entire assembly of grippers 460,470 is translated from the retracted position of gripper 460 to the extended position of gripper 470 by hydraulic cylinders 490,492 which reciprocate the bases for the grippers. Once the workpiece 401 and grippers 460,470 are in the portion of the gripper 470 in FIG. 12, hydraulic cylinders 490,492 serve to retract tapered rigid wedges, such as 472, 474, which causes lateral expansion of the tapered wedges assembly 462,464,472,474 to clamp the workpiece 401. As shown in FIG. 13, hydraulic cylinder 490, when it moves connecting rods 508,510 in the directions indicated by arrows I, J. The rigid inner wedge members 514, 516, which have respective upper and lower generally flat surfaces 520,522, 524,526, will cause rigid outer members 530,532,534,536 with which they are in general surface to surface engagement to move outwardly, thereby compressing the resilient mandrels 550,552 to urge them outwardly, thereby clamping the workpiece 401 between the mandrels 550, 552 and the inner surface of rigid annular outer tool 560. The inner wedges 514,516 will have a taper which will cause outward movement of outer members 530,532,534,536 responsive to axial movement of the inner wedges 514, 516 in a first direction which, in the form shown, is toward hydraulic cylinder 490. Upon movement of inner wedges 514,516, in the reverse direction, resilient mandrels 559, 552 will urge outer members 530,532,534,536 inwardly. FIG. 14 shows a cross-section of a preferred form of tapered clamping member of FIG. 13. Rigid inner wedge 570 is positioned between outer members 572,574. The outer members 572,574 each have an inwardly open re-entrant throat elongated recess 580,582 within which generally T-shaped projections 576, 578 from sides of the inner wedge 570 are slidingly received. This interengagement facilitates hydraulic cylinder induced reciprocation of inner wedge 570, with respect to outer members 572,574 to move the outer members 572, 574. In general, the inner wedges 514,516 of the grippers may travel axially about 5 mm to 10 mm between the retracted and extended positions.

The present, therefore, provides a rapid, effective, automated means for forming elongated tubular metal articles under the influence of a pair of rotatable lower dies. In one embodiment, an overlying first die cooperates with the pair of rotatable lower die in effecting workpiece deformation.

Whereas particular embodiments of the present invention have been described herein for purposes of illustration, it will be appreciated by those skilled in the art that numerous variations of the details may be made without departing from the invention as described in the appended claims.

We claim:

1. Apparatus for forming an elongated tubular metal workpiece comprising a pair of rotatable cooperating die members supported for rotation in opposite directions, gripping means for gripping end portions of said tubular workpiece adjacent to said die members, said gripping means having means for inserting a portion thereof axially into the end portions of said tubular workpiece prior to said forming and maintaining said inserted position during said forming, and means for effecting simultaneous rotation of said die members after said tubular workpiece is gripped by said gripping means.

2. The apparatus of claim 1 including said die members being rotatable about axes oriented generally perpendicular to the longitudinal extent of said workpiece and said rotatable dies and means for effecting rotation thereof being structured to effect said forming by bending said tubular workpiece substantially in a single plane.

3. The apparatus of claim 2 including said die member axis of rotation being disposed between the ends of said workpiece when said workpiece is in position to be formed.

4. The apparatus of claim 2 including hydraulic cylinder means for rotating said die members.

5. The apparatus of claim 4 including said hydraulic cylinder means having a hydraulic cylinder rotatably secured to each said die member.

6. The apparatus of claim 5 including stationary support means secured to the piston rods of each said hydraulic cylinder, whereby extension and retraction of said piston rods will effect responsive rotation of said die members.

7. The apparatus of claim 1 including said gripping means having first gripping means for gripping a first end of a tubular said workpiece and second gripping means for gripping a second end of said tubular workpiece, transport means for moving said first gripping means and said second gripping means toward and away from said workpiece ends, and each said gripping means having at least one tapered gripper which enters the workpiece in effecting gripping.

8. The apparatus of claim 7 including said tapered gripper being metal.

9. The apparatus of claim 8 including means for expanding said tapered grippers which are disposed in said workpiece hollow to grip said workpiece.

10. The apparatus of claim 9 including effecting said expansion by means of a hydraulic cylinder.

11. The apparatus of claim 10 including said tapered grippers having a tapered inner wedge movable within a pair of outer members responsive to movement of said hydraulic cylinders.

12. The apparatus of claim 11 including tongue and groove means on said tapered inner wedge and said outer members to facilitate relative sliding movement therebetween.

13. The apparatus of claim 12 including said outer members having elongated re-entrant recesses as said grooves, and said inner wedges having a generally T-shaped tongue slidingly received within each said re-entrant recess.

14. The apparatus of claim 12 including said outer members being in general surface to surface contact with said inner wedge.

15. The apparatus of claim 1 including said apparatus being structured to effect forming of a said tubular workpiece having more than one hollow portion.

16. A method of forming an elongated tubular workpiece comprising providing a pair of die members rotatable in opposite directions, positioning said tubular workpiece adjacent to said die members, gripping the ends of said tubular workpiece, effecting forming of said gripped workpiece by rotation of said die members to effect bending of said workpiece substantially in a single plane, and subsequently terminating said gripping of said tubular workpiece ends.

17. The method of claim 16 including employing said process to effect bending of an aluminum extrusion.

18. The method of claim 16 including effecting said bending along a curved path.

19. The method of claim 16 including effecting rotation of said die members about generally parallel axes disposed in underlying relationship with respect to said workpiece.

20. The method of claim 19 including effecting said die rotation about said axes with said axes being oriented generally perpendicular to the longitudinal extent of said workpiece.

21. The method of claim 16 including employing said method on a tubular aluminum extrusions, and effecting said gripping by inserting at least a portion of gripping means axially into said ends of said tubular aluminum extrusion.

22. The method of claim 21 including providing a pair of hydraulic cylinders with one rotatably secured to each said die members.

23. The method of claim 22 including applying through said die members tensile forces to said workpiece exceeding the yield point of said workpiece and bending said workpiece.

24. The method of claim 23 including effecting said bending without employing die members other than said rotatable dies.

25. The method of claim 16 including employing said method on a tubular workpiece having more than one hollow portion.

* * * * *